US007129840B2

(12) United States Patent
Hull et al.

(10) Patent No.: US 7,129,840 B2
(45) Date of Patent: Oct. 31, 2006

(54) DOCUMENT SECURITY SYSTEM

(75) Inventors: Jonathan J. Hull, San Carlos, CA (US); Jamey Graham, San Jose, CA (US); Dar-Shyang Lee, Union City, CA (US); Hideki Segawa, Foster City, CA (US)

(73) Assignee: Ricoh Company, Ltd. (JP)

( * ) Notice: Subject to any disclaimer, the term of this patent is extended or adjusted under 35 U.S.C. 154(b) by 968 days.

(21) Appl. No.: 10/235,030

(22) Filed: Sep. 3, 2002

(65) Prior Publication Data

US 2004/0041707 A1 Mar. 4, 2004

(51) Int. Cl.
*G08B 13/14* (2006.01)

(52) U.S. Cl. ..... 340/568.1; 340/572.1; 340/10.42; 235/385

(58) Field of Classification Search ..... 340/568.1, 340/10.42, 572.1–572.8, 825.36, 825.49, 340/10.1; 235/385
See application file for complete search history.

(56) References Cited

U.S. PATENT DOCUMENTS

| | | | | |
|---|---|---|---|---|
| 4,862,160 | A | 8/1989 | Ekchian et al. | |
| 5,287,414 | A | 2/1994 | Foster | |
| 5,666,490 | A | 9/1997 | Gillings et al. | |
| 5,689,238 | A * | 11/1997 | Cannon et al. | 340/572.1 |
| 5,926,116 | A | 7/1999 | Kitano et al. | |
| 5,933,829 | A | 8/1999 | Durst et al. | |
| 5,936,527 | A | 8/1999 | Isaacman et al. | |
| 5,939,981 | A | 8/1999 | Renney | |
| 5,978,477 | A | 11/1999 | Hull et al. | |
| 5,978,773 | A | 11/1999 | Hudetz et al. | |
| 6,055,544 | A | 4/2000 | DeRose et al. | |
| 6,100,804 | A | 8/2000 | Brady et al. | |
| 6,104,834 | A | 8/2000 | Hull | |
| 6,108,656 | A | 8/2000 | Durst et al. | |
| 6,122,520 | A | 9/2000 | Want et al. | |
| 6,127,928 | A | 10/2000 | Isaacman et al. | |
| 6,130,621 | A | 10/2000 | Weiss | |
| 6,176,425 | B1 | 1/2001 | Harrison et al. | |
| 6,195,006 | B1 | 2/2001 | Bowers | |
| 6,199,048 | B1 | 3/2001 | Hudetz et al. | |
| 6,204,764 | B1 | 3/2001 | Maloney | |
| 6,232,870 | B1 | 5/2001 | Garber et al. | |
| 6,249,226 | B1 * | 6/2001 | Harrison et al. | 340/572.1 |
| 6,259,367 | B1 | 7/2001 | Klein | |
| 6,260,049 | B1 | 7/2001 | Fitzgerald et al. | |
| 6,262,662 | B1 | 7/2001 | Back et al. | |
| 6,278,413 | B1 | 8/2001 | Hugh et al. | |

(Continued)

FOREIGN PATENT DOCUMENTS

| | | |
|---|---|---|
| CA | 2354464 | 7/2003 |

(Continued)

OTHER PUBLICATIONS

"Hitachi Announces world's smallest RFID IC, the 'mu-chip,'" company press release, Hitachi Ltd. Tokyo, Japan (2001).

(Continued)

*Primary Examiner*—Phung T. Nguyen
(74) *Attorney, Agent, or Firm*—Townsend and Townsend and Crew LLP

(57) ABSTRACT

Document monitoring provides a measure of document security. Documents incorporating radio frequency identification (RFID) tags can be monitored by appropriate interrogation components for movement activity. A surface suitable for placement of documents is configured for monitoring RFID tagged documents. Such documents can be monitored in a document processing device to control access to the document processing functions.

42 Claims, 5 Drawing Sheets

U.S. PATENT DOCUMENTS

| | | | | |
|---|---|---|---|---|
| 6,294,998 | B1 | 9/2001 | Adams et al. | |
| 6,297,737 | B1 | 10/2001 | Irvin | |
| 6,304,182 | B1 | 10/2001 | Mori et al. | |
| 6,307,473 | B1 | 10/2001 | Zampini et al. | |
| 6,324,353 | B1 | 11/2001 | Laussermair et al. | |
| 6,326,889 | B1 | 12/2001 | Van Horn et al. | |
| 6,333,690 | B1 | 12/2001 | Nelson et al. | |
| 6,335,685 | B1 | 1/2002 | Schrott et al. | |
| 6,337,619 | B1 | 1/2002 | Kowalski et al. | |
| 6,340,931 | B1 | 1/2002 | Harrison et al. | |
| 6,341,931 | B1 | 1/2002 | Bates | |
| 6,354,493 | B1 | 3/2002 | Mon | |
| 6,359,628 | B1 | 3/2002 | Buytaert | |
| 6,380,894 | B1 | 4/2002 | Boyd et al. | |
| 6,427,032 | B1 | 7/2002 | Irons et al. | |
| 6,430,554 | B1 | 8/2002 | Rothschild | |
| 6,434,561 | B1 | 8/2002 | Durst, Jr. et al. | |
| 6,442,563 | B1 | 8/2002 | Bacon et al. | |
| 6,512,919 | B1 | 1/2003 | Ogasawara | |
| 6,542,933 | B1 | 4/2003 | Durst, Jr. et al. | |
| 6,651,053 | B1 | 11/2003 | Rothschild | |
| 6,651,063 | B1 | 11/2003 | Vorobiev | |
| 6,655,586 | B1 | 12/2003 | Back et al. | |
| 6,675,165 | B1 | 1/2004 | Rothschild | |
| 6,766,363 | B1 | 7/2004 | Rothschild | |
| 6,860,422 | B1 | 3/2005 | Hull et al. | |
| 6,865,608 | B1 | 3/2005 | Hunter | |
| 6,892,376 | B1 | 5/2005 | McDonald et al. | |
| 6,993,573 | B1 | 1/2006 | Hunter | |
| 7,006,664 | B1 | 2/2006 | Paraskevakos | |
| 2002/0032698 | A1 | 3/2002 | Cox | |
| 2002/0032707 | A1 | 3/2002 | Takeoka | |
| 2003/0018669 | A1 | 1/2003 | Kraft | |
| 2003/0102970 | A1 | 6/2003 | Creel et al. | |
| 2003/0179908 | A1 | 9/2003 | Mahoney et al. | |
| 2003/0191719 | A1 | 10/2003 | Ginter et al. | |
| 2003/0214388 | A1 | 11/2003 | Stuart et al. | |
| 2004/0017313 | A1* | 1/2004 | Menache | 342/465 |
| 2004/0041696 | A1 | 3/2004 | Hull et al. | |
| 2004/0044956 | A1 | 3/2004 | Huang | |
| 2004/0078749 | A1 | 4/2004 | Hull et al. | |
| 2004/0079796 | A1 | 4/2004 | Hull et al. | |
| 2004/0181756 | A1 | 9/2004 | Berringer et al. | |
| 2004/0205455 | A1 | 10/2004 | Dathathraya | |
| 2004/0257231 | A1 | 12/2004 | Grunes et al. | |
| 2005/0035862 | A1* | 2/2005 | Wildman et al. | 340/573.1 |
| 2005/0105724 | A1 | 5/2005 | Hull et al. | |
| 2005/0182757 | A1 | 8/2005 | Hull et al. | |

FOREIGN PATENT DOCUMENTS

| | | | |
|---|---|---|---|
| DE | 19646153 | A1 | 5/1998 |
| FR | 2782703 | A1 | 3/2000 |

OTHER PUBLICATIONS

"Workflow Management Coalition Workflow Standard-Interoperability Wf-XML Binding," The Workflow Management Coalition Specification, May 1, 2000, Version 1.0, Copyright 1999, 2000 The Workflow Management Coalition, pp. 4-40 (2000).

Allen "Workflow: An Introduction," *Workflow Handbook*, Workflow Management Coalition, pp. 15-38 (2001).

KWON "Tiny Bay Area Invention Could Change Security," on-line article available at http://www.kpix.com, KPIX Channel 5, San Francisco, CA 94111-1597 (2001).

Want et al. "Bridging Physical and Virtual Worlds with Electronic Tags," In Proc. ACM CHI'99 pp. 370-377 (1999).

Want et al. "Expanding the Horizons of Location-Aware Computing," IEEE Computer 34:31-34 (2001).

Want et al. "Ubiquitous Electronic Tagging," IEEE Distributed Systems Online 1:1-6 (2000).

WC3®, "URIs, URLs, and URNs: Clarifications and Recommendations 1.0, Report from the joint W3C/IETF URI Planning Interest Group," downloaded from http://www.w3.org/TR/uri-clarification/ on Jun. 9, 2005.

Web pages from PaperClick.com printed from http://www.paperclip.com on Jun. 14, 2006.

* cited by examiner

DOCUMENT SECURITY SYSTEM

CROSS-REFERENCES TO RELATED APPLICATIONS

This application incorporates by reference the entire contents of the following applications for all purposes:

(1) U.S. patent application Ser. No. 10/235,035.

(2) U.S. patent application Ser. No. 10/235,042.

(3) U.S. patent application Ser. No. 10/235,032.

(4) U.S. patent application Ser. No. 10/235,028.

(5) U.S. patent application Ser. No. 10/234,414 filed concurrently with this application, now U.S. Pat. No. 6,860,422, issued Mar. 1, 2005, entitled "Method and Apparatus for Tracking Documents in a Workflow"

The present application incorporates by reference the entire disclosure of the following patent for all purposes:

(1) U.S. Pat. No. 5,978,477, issued Nov. 2, 1999 entitled "AUTOMATIC AND TRANSPARENT DOCUMENT ARCHIVING."

BACKGROUND OF THE INVENTION

The present invention relates generally to security systems and more particularly to document monitoring systems and methods to effect document security.

In any project involving a group of people, cooperative and coordinated interaction typically is key to the success or failure of the undertaking. The project begins with a series of meetings to identify the desired goals, and to begin understanding the tasks needed to achieve the goal. In a marketing situation, for example, product managers and sales persons convene frequently to define the product line or services, to identify potential markets and target customers, to develop advertising strategies and product roll-out scenarios, and so on. In an engineering setting, basic design goals and basic implementation strategies are discussed and identified.

An important though somewhat tedious outcome of this effort is the production of many documents. Most documents are freely distributed among individuals. Invariably, however, a number of documents will be produce that contain sensitive information. Engineering plans and designs might have to be documented, but kept secret or otherwise secured. Marketing plans and forecasts, and customer lists are typically sensitive subject matter that require controlled access.

These sensitive documents, nonetheless, need to be copied, distributed, and otherwise disseminated among many individuals in the organization in order for progress to occur. A need therefore exists for a method and system to provide document security support.

SUMMARY OF THE INVENTION

Document monitoring includes sensing documents placed on a suitable surface and monitoring the documents for changes in position on the surface. Sensors collect first information indicative of a first position, and second information indicative of a second position. The sensor data is compared to determine that a change in position occurred. In one embodiment, a recording action can be initiated in response to detection that a change in position has occurred. In another embodiment of the invention, document processing functions can be enabled or disabled, based on the information collected by the sensors. In one aspect of the invention, the sensor component comprises a radio frequency identification (RFID) tag and associated interrogation device(s).

DESCRIPTION OF THE SPECIFIC EMBODIMENTS

Figure 1:
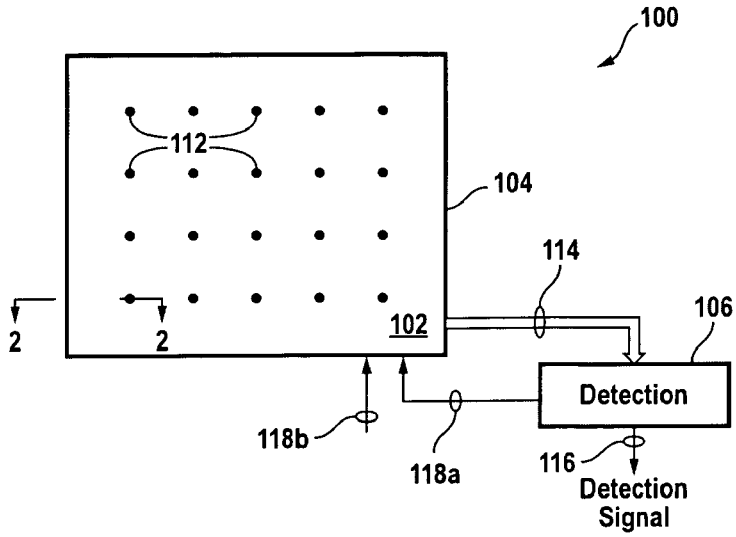
FIG. 1 is a simplified block diagram of a sensor arrangement for monitoring documents in accordance with an embodiment of the present invention.

FIG. 1 is a schematized representation illustrating by way of example an embodiment of a document monitoring device according to the present invention. The document monitoring device 100 includes a structure 104 that is suitable for placement of one or more documents. The structure can be a desktop, for example, or other similar worksurface. The structure can be a shelf in a bookcase, or perhaps a document bin of a document processing apparatus such as a copier or printer, and so on.

The document monitoring device further includes an arrangement of sensors 112 disposed about an area of the structure 104. As can be seen in the figure, the sensors are arrayed in a regular pattern. It will be appreciated that the sensors can be arranged in any regular pattern other than the rectangular pattern shown. Moreover, it will be appreciated that the sensors can be arranged in an irregular or otherwise random pattern.

A detection module 106 receives an output signal 114 that represents a collection of the signals produced by the sensors 112. The detection module produces a detection signal 116 based on the output signal. The detection module can be an appropriately configured computer processor or an analog device, depending on the nature of the output signal 114. As will be seen below, in a particular implementation of an embodiment of the invention, the output signal is digital, and so the detection module can be a digital processing device.

A control signal 118A is coupled to the sensors 112 to control their action. In one embodiment of the invention, the control signal is produced by the detection module 106. This configuration might be appropriate for providing synchronous operation between the sensors 112 and the detection module. Alternatively, as can be seen in FIG. 1, a control signal 118B can be provided from a source other than the detection module.

Figure 2A:
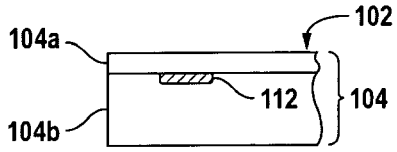
FIGS. 2A–2C illustrate typical examples of incorporating sensors in a surface.
Figure 2B:
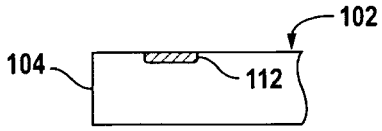
Figure 2C:
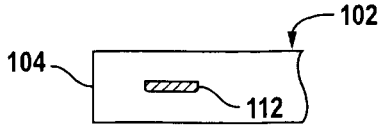

FIGS. 2A–2C show alternative embodiments of the incorporation of sensors 112 in the structure 104, as seen from the cross-sectional view taken along view line 2—2 shown in FIG. 1. The embodiment shown in FIG. 2A illustrates the structure 104 having one or more laminations 104*a*, 104*b*, showing the sensor 112 disposed within the material of the lamination 104*b*. An example of this construction can be a desktop having a protective layer of glass 104*a*, where the sensors might be embedded in the material (e.g., wood) of the desktop 104*b*. FIG. 2B shows an embodiment in which the sensors are simply embedded in the structure, flush with the surface 102 of the structure. FIG. 2C shows yet another embodiment in which the sensors are embedded below the surface 102 of the structure. It can be appreciated from these example embodiments that the sensors can be incorporated with the structure 104 in a variety of ways.

Figure 3A:
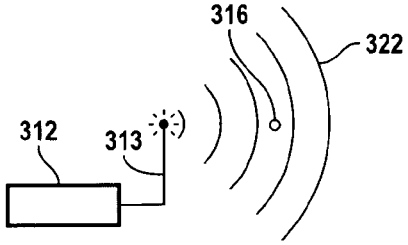
FIG. 3A (Prior Art)
FIGS. 3A and 3B show a typical radio frequency identification system.
Figure 3B:
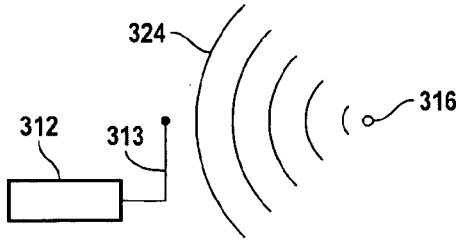
FIG. 3B (Prior Art)

The components of a radio frequency identification system (RFID) are used in a particular implementation of this embodiment of the invention. RFID is a versatile wireless solution for identification. It has a wide range of applications, from tracking books in a library to monitoring the movement of cattle on a ranch. FIGS. 3A and 3B show that a basic RFID system comprises three components: an antenna component (coil) 313, a transceiver component 312, and a transponder (commonly called an RFID tag) 316.

The antenna component 313 emits radio signals to activate the tag 316. Antennas are available in a variety of shapes and sizes. Thus, it can be appreciated that antennas can constitute the sensors 112 shown in FIGS. 1 and 2A–2C, in this particular implementation of the invention.

Often, the antenna component 313 is packaged with a transceiver component 312 which typically includes a decoder module. This combination is referred to variously as a reader, an interrogator, and so on. In operation, the reader can emit radio waves 322 (interrogation signal) in ranges of anywhere from one inch to several feet or more, depending upon its power output and the radio frequency used. The transceiver component produces the interrogation signal which is then propagated by the antenna component.

When an RFID tag passes through the electromagnetic zone of the interrogation signal, it responds to that signal and produces a response signal 316 which is picked up by the antenna component 313 and fed to the transceiver component 312. The decoder module in the transceiver decodes the response signal to extract the data encoded in the tag and the data is passed to a host computer for subsequent processing.

RFID tags come in a wide variety of shapes and sizes. Some tags can only be read, while other tags can be read and written. For example, a product called the MU-chip by Hitachi, Ltd., is a 0.4 $mm^2$ chip that is thin enough (about 60 μm) to be embedded in paper, and contains a read-only memory (ROM) of 128 bits.

RFID tags are categorized as either active or passive. Active RFID tags are powered by an internal battery and are typically read/write, i.e., tag data can be rewritten and/or modified. The battery-supplied power of an active tag generally gives it a longer read range. The trade off of course is greater size, greater cost, and a limited operational life due to the limited life of the battery. Nonetheless, it can be appreciated that active tags can be useful in the present invention under appropriate operational requirements.

Passive RFID tags operate without a separate external power source and obtain operating power generated from the interrogation signal transmitted from the reader. Passive tags are consequently much lighter than active tags, less expensive, and offer a virtually unlimited operational lifetime. The trade off is that they have shorter read ranges than active tags and require a higher-powered reader. Read-only tags are typically passive and are programmed with a unique set of data (usually 32 to 128 bits) that cannot be modified. For example, the Hitachi MU-chip comes preprogrammed with a 128 bit data word.

In accordance with the present invention, physical documents have one or more RFID tags physically associated with them. A plethora of attachment processes are possible. An RFID tag can be attached by the use of adhesives. A clip which gathers together a multi-page document can be provided with an RFID tag. For example, a paper clip may incorporate a tag, or a staple can be incorporated with a tag.

The attachment can be manual, or by automation. For example, a copying machine can be outfitted with RFID tagged staples or a dispenser of adhesive tags, so that stapled copies can be tagged by way of the staple, or single-page copies can be tagged with an adhesive tag. RFID tags (e.g., Hitachi MU-chip) can be embedded in the paper medium itself ("tagged paper").

In accordance with this particular implementation of an embodiment of the invention, each RFID tag is associated with a unique identification, referred to herein as a "tag identifier." Furthermore, when a tag is physically associated with a physical document, there is an association between the tag identifier and "document information" relating to the physical document. The document information might comprise an electronic copy of the physical document, an image of the document, a reference which identifies the physical or an electronic form of document, a reference identifying where an electronic copy of the physical document can be found, references to other documents, and so on. The document information might include information indicative of permissions, for example, whether a document can be copied or not. The document information might include ownership information, document modification history information. In general, one can appreciate that any kind of information may constitute "document information."

The document information can be collected at the time of creation of the document; e.g., when the document is printed, copied, faxed, or otherwise processed. The document information can be an accumulation of information collected during the lifetime of the document such as when modifications are made, or when copies are made, for example. A database system (not shown) can be provided to store such information, or other suitable information management system. The database or information management system can be used to provide the mapping between tag identifier and document information.

Figure 4:
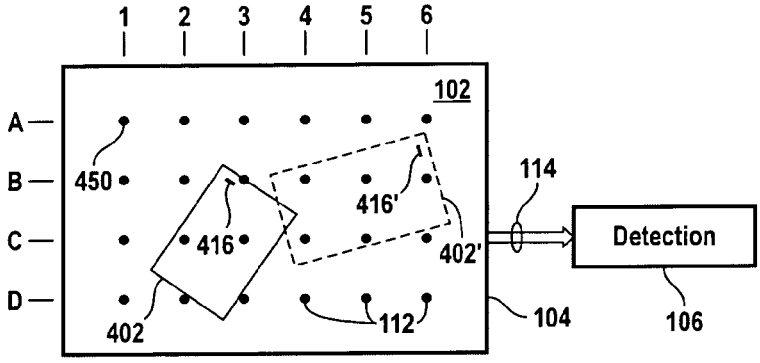
FIGS. 4 and 4A illustrate document monitoring in accordance with an illustrative embodiment of the present invention.

FIG. 4 illustrates how document monitoring in accordance with an embodiment of the present invention can be provided. On the surface 102 of the structure 104 is a document having associated therewith an RFID tag 416. As can be seen in the figure, the document has a first position 402 on the surface, and a second position 402' shown in phantom.

In the particular embodiment shown in FIG. 4, the sensors 112 are interrogation circuits comprising a transceiver circuit 312 (FIG. 3A) to produce an interrogation signal 322. The response signal picked up by the antenna component 313 of each sensor is detected by the transceiver circuit. However, not all of the sensors will detect the response signal. Since the response signal is typically weak, especially in the case of a passive RFID tag, only those sensors within the transmission range of the response signal generated by the tag 416 will be able to detect the signal.

Figure 6A:
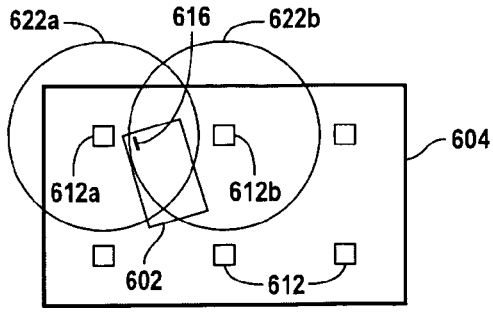
FIGS. 6A and 6B show the transmission range characteristics of an RFID system.
Figure 6B:
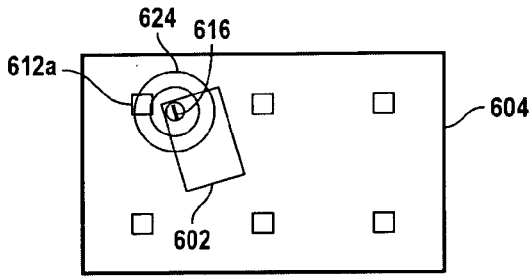

The limited transmission range of an RFID tag is illustrated in FIGS. 6A and 6B. In FIG. 6A, all of the interrogators 612 transmit an interrogation signal 622 (though, for clarity, only the signals 622*a* and 622*b* for two interrogators 612*a* and 612*b*, respectively, are shown). A document 602 having an associated RFID tag 616 is exposed to the electromagnetic radiation. FIG. 6B shows the response signal 624 produced by the tag 616. However, since the signal strength of the response signal is low, its range is limited and is therefore not detected by all of the interrogators. Rather, (in this case) the response signal is detected only by the interrogator 612*a*.

Figure 4A:
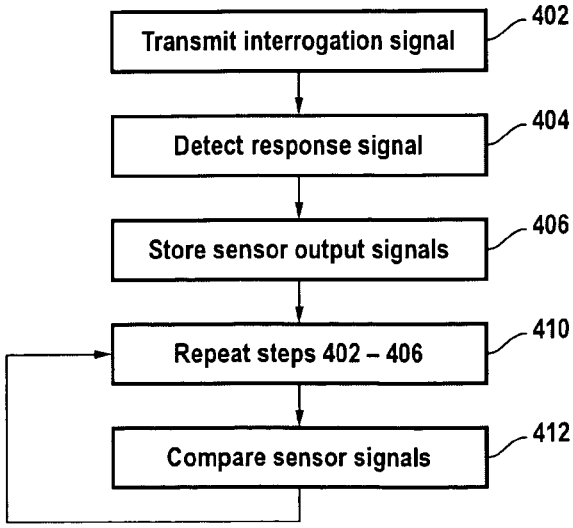

FIG. 4A shows a high level flowchart for the processing which occurs for the arrangement shown in FIG. 4. Consider that each sensor 112 transmits an interrogation signal, at a time $t_0$, in a step 402. As discussed above, the response signal of the tag 416 will be detected (step 404) only by those sensors that are within the transmission range of the tag. Those sensors which detect the response signal each will produce a sensor output signal, which typically comprises some information that is stored in the tag 416; e.g., an identification code. The collection of sensor output signals is collectively represented by the output signal 114 (FIG. 1). The detection module 106 receives a first set of sensor output signals and stores them (step 406) as first information indicative of the first position 402 of the document.

Now, consider a time $t_1$ ($>t_0$) when the document has been moved. This is indicated by the document (in phantom) shown in position 402'. At a time $t_2$ ($>t_1$), a second interrogation signal is transmitted by the transceiver circuits of the sensors 112 (step 402), another set of sensors will detect the response signal produced by the tag 416 (step 404). A second set of sensor output signals is produced as output signal 114 and stored in the detection module 106 (step 406) as second information indicative of the second position 402' of the document. Movement of the document can then be determined (step 412) based on the first sensor output signals and the second sensor output signals.

In one particular implementation of an embodiment of the invention, the detection module 106 can process the sensor output signals by associating each signal with information indicating the location of the sensor. For example, the sensor output signal received from the sensor 450 might be associated with a location identified by the coordinate (A,1). Thus, movement of the document is determined from the point of view of comparing the locations of those sensors which detected the tag's 416 response signal at time to with the location of those sensors which detected the response signal at time $t_2$.

Alternatively, the detection module 106 can process the sensor output signals by associating the sensor output signals with the sensors 112 themselves. For example, the sensor output signal can contain information indicative of a tag identifier, thus identifying the tag. Document movement can be detected by comparing the tag identifiers obtained from the first set of sensor output signals against the tag identifiers obtained from the second set of sensor output signals.

Figure 5A:
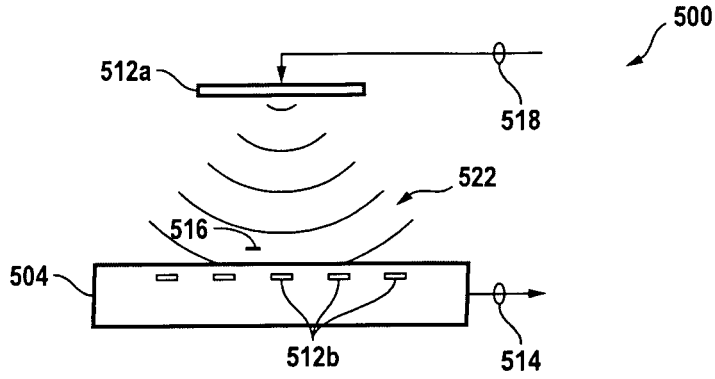
FIGS. 5A–5C illustrate in block diagram form a sensor arrangement according to another embodiment of the invention.
Figure 5B:
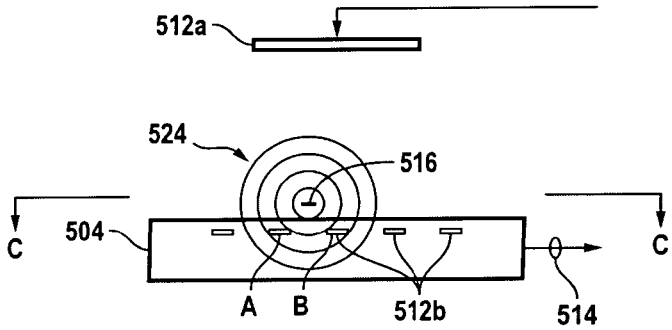
Figure 5C:
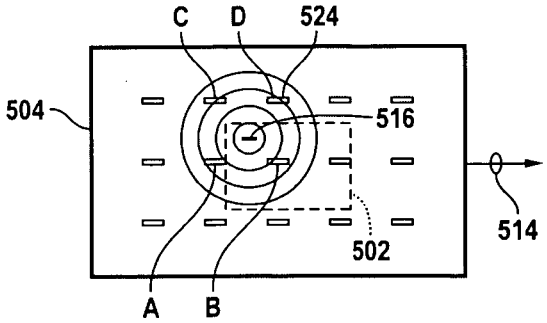

FIGS. 5A–5C show a document monitoring apparatus in accordance with another embodiment of the present invention. The apparatus 500 includes a structure 504 suitable for placement of documents. A plurality of receiver components 512*b* are disposed about an area of the structure. FIGS. 2A–2C illustrate examples of how the receiver components can be incorporated with the structure 504. Outputs of the receiver components are collected and provided as output signal 114. In this particular embodiment of the present invention, a single transmitter circuit 512*a* is provided for transmitting an interrogation signal 522 in response to a control signal 518. An RFID tag 516 is shown disposed on the surface of the structure 504.

The receiver component 512*b* comprises an antenna component (e.g. 313 in FIG. 3A) for sensing the a response signal from the tag 516. The receiver component further includes circuitry (not shown) for detecting a response signal picked up by the antenna. The receiver component constitutes a portion of the conventional interrogator device such as the one shown in FIGS. 3A and 3B. In this particular embodiment of the invention, the transceiver component of a conventional interrogator is separated into a transmitter circuit component 512*a* and plural receiver circuit components 512*b*. The plural receiver components are disposed about the structure 504.

FIGS. 5B and 5C show the propagation of a response signal 524 from the tag 516 after irradiation by the interrogation signal 522. FIG. 5C is a top view taken along view line C—C in FIG. 5B. The figures illustrate the limited range of the response signal, and the consequent detection of the signal by less than all of the receiver components 512*b;* in this case, receiver components A–D are shown having sensed the response signal. The tag 516 is shown physically associated with a document 502 illustrated in phantom.

Figure 7:
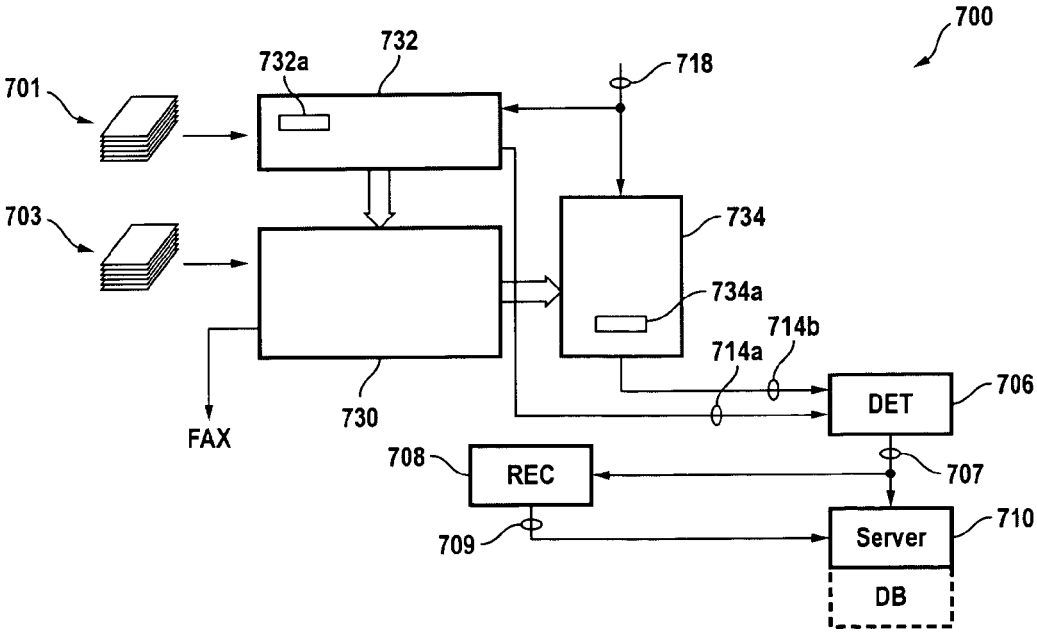
FIG. 7 shows a block diagram of a document processing system incorporating various aspects of the present invention.

FIG. 7 is a block diagram illustrating document monitoring in accordance with yet another embodiment of the present invention. The figure shows a document processing apparatus 700. For example, this might be a copier machine, or a facsimile transmission device, or a printer, and so on. The document processing apparatus comprises a document source 701, abstractly represented by a stack of documents. An input component 732 processes the document source. For example, in the case of a copier or facsimile transmission device (fax), the document source might be the physical documents being copied and the input component is an imaging device. The document source could even be a data connection to a data processing device, where the document is electronically provided to the copier or fax. In the case of a printer, the document source 701 is likely to be a network connection to a document server or some data processing device, and the input component might be a network interface component to receive the electronic data constituting the document.

The input component 732 is coupled to a document production component 730 to produce copies or printout. A paper source 703 feeds paper stock to the document production component. In this embodiment of the invention, the RFID tags can be physically associated with the produced document by the document production component. For example, a feeder mechanism for adhesive tags can be incorporated into the document production component that attaches tags to the paper stock as it passes during a copying operation or a printing operation. As another example, a stapling mechanism having a magazine of staples comprising RFID tags can bind and tag multi-page documents. Alternatively, the paper stock itself may be "tagged paper", having RFID tags incorporated directly in the paper.

In the case of a facsimile transmission device, the document production component 730 might comprise data communication circuitry for connecting to a remote facsimile transmission device and communicating an electronic copy (FAX) of the document to the remote device.

The document processing device 700 includes a suitable output tray 734, provided for receiving the copy; e.g., copied document, printed document, or the originals.

A detection module 706 includes a signal connection 714*a*, 714*b* to either or both the input component 732 and the output tray 734. As will be discussed below, the signal connection provides information about the document(s) present in the input component and/or the output tray. The detection module feeds a signal 707 to a recording component 708 and to an appropriate server system 710.

A recording component 708 is provided to record information that identifies an individual. The recording component can include an input device for users to key in or otherwise provide information indicating their identity, which can then be use to activate the document processing device 700. The recording component can include a video recording device which produce an image 709 of the individual. The image can then be fed to the server 710 which can perform appropriate image analysis to determine the individual's identity.

In one embodiment, the input component 732 may include an RFID interrogation device 732*a* for sensing source documents 701 which contain RFID tags. A control signal 718 is coupled to the input component to control the interrogation device; e.g. to produce the interrogation signal. In the case of a copier, the recording component 708 can obtain information indicating of the user. The information can be an identification code or an image of the user. When source documents 701 are fed to the copier, the input component 732 can sense tags in the source documents and send appropriate signals 714*a* to the detection module 706. The signals fed to the detection module might include tag identifiers. The identification information supplied by the recording component and the tag information supplied by the detection module can be processed by the server 710. The server can then enable (by way of suitable control signals, 718 for example) the copying function based on the information received.

For example, the tag information can be mapped to some information that identifies the document. As discussed above, this information can be anything, such as a document identifier, an image of the document, and so on. The tag information, also can be mapped to corresponding permission information dictating what actions (copy, fax to a specific destination, etc.) are permitted for the particular user for the particular document. In general, a requested action of the document processing device 700 can be enabled or disabled based on information collected by the recording component and on the information received by an RFID interrogation device 732*a* contained in the input component 732.

In yet another embodiment according to the present invention is the incorporation of a hash code in a re-writable RFID chip (tag). The hash code (see, for example, the web site at "http://userpages.umbc.edu/~mabzug1/cs/md5/md5.htm1" for a discussion of the md5 hash algorithm) can be applied to a digital representation of the document (e.g., post-script (ps), or scanned image) before it is printed. The md5 hash is supposed to produce a unique 128 bit output for every unique document. The hash code can be stored in the RFID chip. Later, a user needing to verify that two physical documents have exactly the same content can merely scan the RFID chip and compare the hash codes. Note that a visual side-by-side comparison of two document can be difficult, especially if there are only small differences between the two versions of the document (e.g., just a few words are different). However, the comparison is extremely easy if the hash codes are used. Also, note that the two documents being compared might have been printed at different times by different people in different locations, according to different formatting rules (e.g., single column format or double column format). The use of hash codes to compare two such documents would be extremely accurate. Also, note that the comparison could be made at different locations by different people, but sharing a common communication channel. This could be part of a contract signing process in which the same contract is printed at different locations by different people. The md5 hash code could be read from the chip and printed (i.e., handwritten) on the contract near the signature line. Images of the signed contract could be exchanged between the signatories. Each would be guaranteed that the content of the contract was exactly the same.

In accordance with still another embodiment of the invention, the output tray 734 may be provided with one or more interrogation devices 734*a* disposed as illustrated, for example, in FIG. 1. In this embodiment, any documents having physically associated RFID tags can be monitored for movement in the output tray. This can include monitoring for a change in position of the document, or its removal. When sensitive material is left in the output tray, it might be desirable to detect a change in position which can indicate that someone moved some documents to have a look at the sensitive information.

When movement is detected, an appropriate signal from the interrogation device(s) is produced as discussed above. The interrogation output signals 714*b* can be sent to the detection module 706. The detection module can then signal the recording device 708 to capture audio and/or visual information of the vicinity to record the event and the individual who caused the event. This information can then be sent to the server 710 along with information obtained by the detection module from the output tray to record what document was moved (or removed), when the event occurred, and the individual who caused the event.

The server 710 can act as a central database to store the document history mentioned above. Document history can be accumulated in numerous ways. For example, "unconscious capture" of documents is a technique whereby automatic document capture occurs without being initiated by the user. Such techniques are disclosed in commonly owned U.S. Pat. No. 5,978,477 and U.S. patent application Ser. No. 09/347,953, filed Jul. 6, 1999, the entire contents of which are herein incorporated by reference for all purposes. Other document capture schemes, of course, can be used to create the document history database. The history that is accumulated can then be searched based on content to retrieve documents and to view their security histories.

A desirable characteristic of the document security system of the present invention would be for the documents to carry their security histories in the RFID chips. This can be accomplished by using re-writable RFID chips. Thus, in accordance with another embodiment of the present invention, a re-writable RFID tag can be used to store portions of the document history. Referring back to FIG. 7, the RFID interrogation devices 732*a* and/or 734*a* can be configured to produce signals suitable to effect storage of information on re-writable RFID tags disposed in the documents.

Re-writable RFIDs allow users to easily determine information like when the document was printed, when it was removed from the output tray, who removed it, when it was moved on a desktop, etc. Storing the security history on the chip simplifies later access to that information since a network connection or retrieval from a central database are not required. It is can be appreciated that similar history information could be computed for documents that do not have re-writable chips (i.e., simple read-only chips). Such information would be stored in a central database (e.g., component 710 in FIG. 7) for storage and retrieval of that information.

In an implementation of this embodiment of the invention, the security history of a document includes information representative of the locations where a document was present, when it was present at those locations, when it was moved while at those locations, and when it was removed from those locations. An example of an entry in such a history might be:

"15 page document 215624" printed Printer_8780 "Aug. 12, 1998" 15:47

This identifies the document generically as a 15 page document and associates that with a unique identification number that can be used to retrieve the contents of the document from a central database. It also identifies the device it was printed on (Printer_8780) and the date and time when it was printed. Of course, this information could be compressed with generally well known techniques such as zip to reduce the storage space required on the chip.

The next entry in the history list would show the date and time when the document was removed from the output tray of the printer:

"15 page document 215624" removed Printer_8780 "Aug. 12, 1998" 16:08

This could be performed by the interrogation devices 732*a* and/or 734*a* that monitor the motion of the RFID chip attached to this document. The device(s) could include circuitry that writes the memory of the chip at the instant when the document is removed from the output tray.

However, it is possible that the speed of the physical removal from the tray may exceed the speed of operation of that circuitry. In an alternative embodiment, the device(s) could include rewriting circuitry that constantly rewrites the last history entry (the "removed" record) in a chip. This can be done while the document is present in the output tray but before it is moved. In this way, no matter how fast the document is removed, the time of that removal can be recorded.

Figure 8:
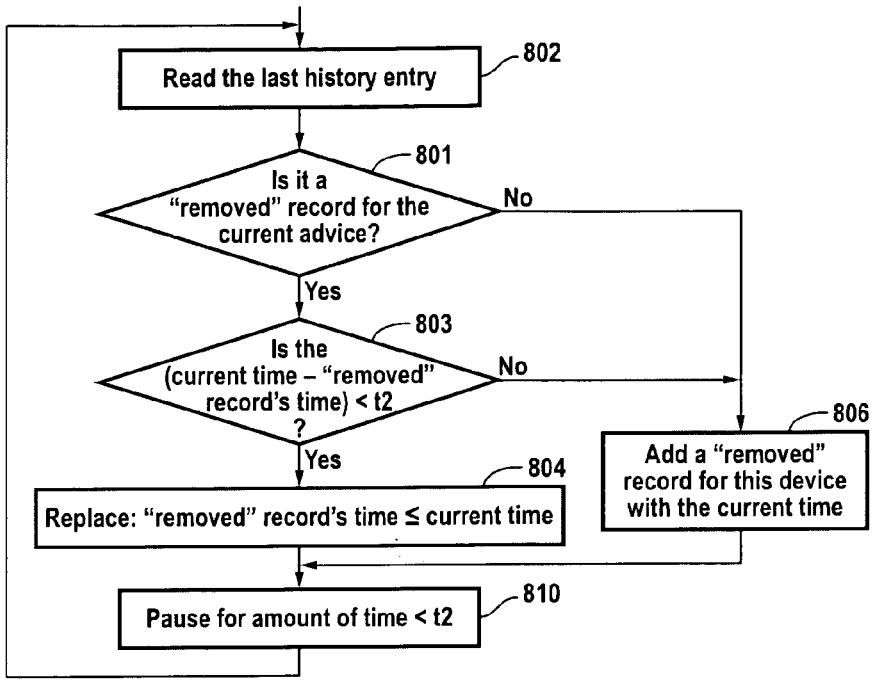
FIG. 8 is a flowchart highlighting the steps for writing to a re-writable RFID tag.

FIG. 8 is a flowchart highlighting the steps for the rewriting process of the rewriting circuitry. When a document comes into contact with the document security system, it reads the entry in the RFID tag in a step 802. If it is determined in a step 801 that the tag does not contain a "removed" record, then it is added in a step 806. If there is a "removed" record in the tag, then the history rewriting circuitry, in a step 803, will determine whether the amount of time since the last history update exceeds a threshold, t2. If any of these conditions are satisfied, a new "removed" record is added to the history list (step 806) and the updating process begins again (step 810). If the threshold t2 is not exceeded in step 803, then the stored recorded time record is simply replaced in a step 804 by a record with the current time. It can be appreciated that this same updating algorithm could be used for an output tray monitoring application, a desktop security implementation, or other similar document tracking system. However, the time threshold value might be different.

Figure 9:
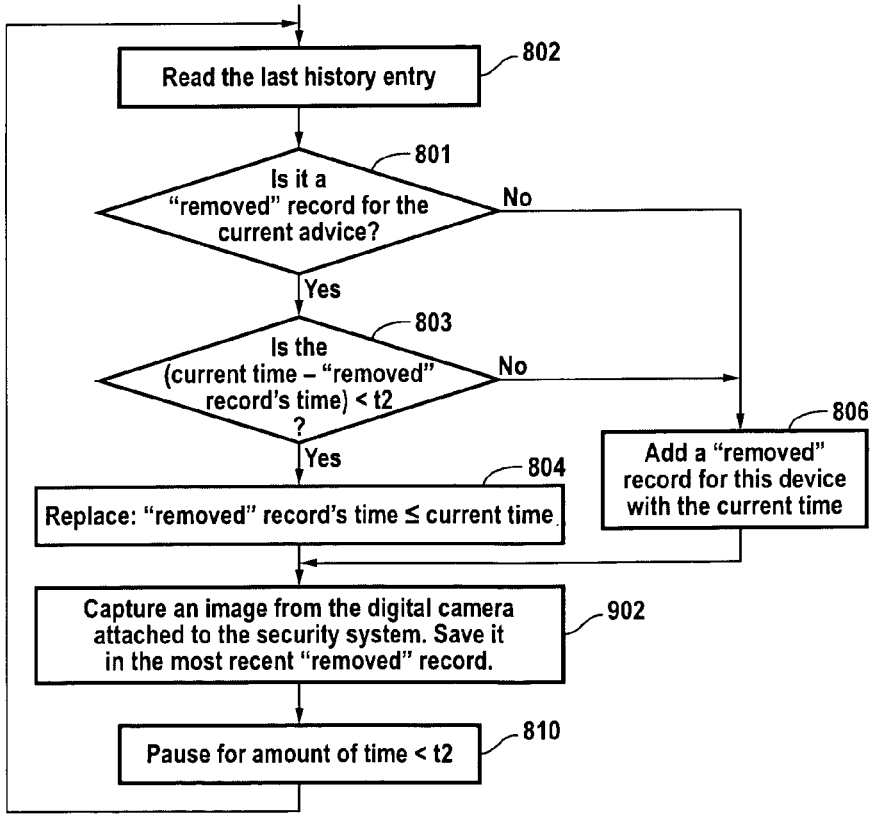
FIG. 9 is a flowchart highlighting the steps for an algorithm for writing to a re-writable RFID tag which includes image capture.

A modified version of this algorithm (shown in FIG. 9) could also store an image in the "removed" record captured by a camera attached to the security system, step 902. Even though many irrelevant images might be captured, the algorithm would guarantee that the image finally stored in the "removed" record would be of the person who removed the document from the device.

What is claimed is:

1. A document monitoring device comprising:

a plurality of sensors disposed about an area of a structure suitable for placement of one or more documents, each sensor producing a sensor output signal in response to sensing a response signal produced by a document; and a detection module coupled to receive sensor output signals from said sensors to produce a detection signal indicative of movement of a first document disposed on said structure, wherein a first set of sensor output signals that are produced by a first set of said sensors is associated with a first position of said first document and a second set of sensor output signals that are produced by a second set of said sensors is associated with a second position of said second document, wherein said detection signal is produced based on said first set of sensors and said second set of sensors.

2. The device of claim 1 further including a recording device operable to collect audio, or visual, or audio-visual data in response to a presence of said detection signal to produce captured data.

3. The device of claim 2 further including associating said captured data with information indicative of said first document.

4. The device of claim 2 wherein said captured data includes image data representative of a person who caused said movement of said first document.

5. The device of claim 1 wherein each said sensor includes circuitry to generate an interrogation signal suitable for producing said response signal from a radio frequency identification device (RFID) disposed upon said structure.

6. The device of claim 5 wherein said RFID device is disposed in said document and is re-writable, and said interrogation signal is suitable to effect storage of first information on said RFID device, said first information representative of said detection signal wherein a history of movement of said document can be stored in said RFID device.

7. The device of claim 1 further including at least one signal source to generate an interrogation signal suitable for producing said response signal from a radio frequency identification device (RFID) disposed in said document.

8. The device of claim 7 wherein said RFID device is re-writable and said interrogation signal is suitable to effect storage of first information on said RFID device, said first information representative of said detection signal wherein a history of movement of said document can be stored in said RFID device.

9. The device of claim 1 wherein said sensors are radio frequency identification device (RFID) interrogation devices suitable for interrogating at least one RFID component that is physically associated said first document.

10. The device of claim 1 wherein said sensors are arranged in a regular pattern.

11. The device of claim 1 wherein said sensors are arranged in an irregular pattern.

12. The device of claim 1 as incorporated in an output tray of a document processing apparatus, and including a recording device operatively coupled with said detection signal and in response to said detection signal operative to collect audio, or visual, or audio-visual data.

13. The device of claim 12 wherein said document processing apparatus includes one of a printer, a copier, and a facsimile transmission machine.

14. A document monitoring device comprising:

an interrogation source to produce an interrogation signal;

a plurality of sensors disposed about an area of a structure suitable for placement of one or more documents, each sensor responsive to proximity of a document by producing a sensor output signal, said document producing a response signal upon exposure to said interrogation signal, said response signal being detectable by one or more of said sensors; and a detection module coupled to receive sensor output signals from said sensors to produce a detection signal indicative of movement of a first document disposed on said structure.

15. The device of claim 14 wherein said interrogation source comprises a transmitter to generate and transmit an interrogation signal suitable to produce a response signal from a radio frequency identification (RFID) tag.

16. The device of claim 15 wherein said RFID tag is a re-writable, said interrogation signal being suitable to effect storage of information on said RFID tag, wherein said information is representative of said detection signal.

17. The device of claim 15 wherein said sensors comprise an antenna and a receiver circuit suitable to detect said response signal.

18. The device of claim 14 wherein a first set of sensor output signals that are produced by a first set of said sensors is associated with a first position of said first document and a second set of sensor output signals that are produced by a second set of said sensors is associated with a second position of said second document, wherein said detection signal is produced based on determining whether said first set of sensors is the same as said second set of sensors.

19. A method for monitoring a first document disposed atop a surface, said first document having at least one radio frequency identification device (RFID) tag physically associated therewith, the method comprising:

in a first period of time, transmitting one or more first interrogation signals and in response thereto receiving one or more first response signals from said RFID tag;

in a second period of time, transmitting one or more second interrogation signals and in response thereto receiving one or more second response signals from said RFID tag; and based on said first response signals and said second response signals, determining whether a position of said first document has changed between said first period of time and said second period of time.

20. The method of claim 19 further including producing captured data comprising audio, or visual, or audio-visual data in response to a determination that said position of said first document has changed.

21. The method of claim 20 wherein said RFID tag is re-writable, the method further including storing said captured data on said RFID tag.

22. The method of claim 20 further including associating said captured data with information indicative of said first document.

23. The device of claim 20 wherein said captured data includes image data representative of a person who caused said changed of position of said first document.

24. The method of claim 19 wherein said one or more first response signals are received at one or more first locations, said one or more second response signals are received at one or more second locations, and said comparing includes comparing said first locations and said second locations.

25. The method of claim 19 wherein said one or more first response signals and said one or more second response signals each is associated with a sensor, said comparing includes comparing the set of sensors associated with said first locations and the set of sensors associated with said second locations.

26. The method of claim 19 wherein said one or more first interrogation signals are transmitted from a plurality of locations and said one or more second interrogation signals are transmitted from said plurality of locations.

27. The method of claim 19 as incorporated in a desktop.

28. The method of claim 19 further including collecting audio, or visual, or audio-visual data in response to a determination that said position of said first document has changed.

29. The method of claim 28 as incorporated in a document processing device.

30. The method of claim 29 wherein said document processing device includes one of a printer, a copier, and a facsimile transmission machine.

31. Apparatus for monitoring documents having radio frequency identification (RFID) devices physically associated therewith, the apparatus comprising:

interrogation means for interrogating an RFID device disposed on a surface of a structure, said RFID producing one or more response signals in response to said interrogating;

sensing means for sensing said response signals at a plurality of locations arranged about said structure; and detection means for detecting a change in location of said RFID device on said surface based on a first set of response signals and a second set of response signals, wherein said first set of response signals are produced when said RFID device is at a first position and said second set of response signals are produced when said RFID device is at a second position.

32. The apparatus of claim 31 wherein each response signal is associated with one of said locations, wherein said detecting a change in location is based on differences between locations of said first response signals and locations of said second response signals.

33. The apparatus of claim 31 wherein said sensing means comprises a plurality of antennas, wherein said detecting a change in location is based on differences between antennas which received said first response signals and antennas which received said second response signals.

34. The apparatus of claim 31 wherein said interrogation means includes a plurality of interrogation circuits disposed about said structure.

35. In a document processing device, a document monitoring component comprising:

at least one interrogation source to produce an interrogation signal;

a plurality of sensors disposed about a document reception area suitable for receiving one or more documents, each sensor responsive to proximity of a document and operable to produce a sensor output signal indicative of said document;

a detection module coupled to receive sensor output signals from said sensors to produce a detection signal indicative of movement of a first document disposed on said structure; and a recording device operatively coupled to receive said detection signal and to obtain user identification information representative of a user, wherein said document produces a response signal upon exposure to said interrogation signal and said sensors can detect said response signal, wherein a first set of sensor output signals is associated with a first position of said first document and a second set of sensor output signals is associated with a second position of said second document, wherein said detection signal is produced based on said first set of sensor output signals and on said second set of sensor output signals.

36. The device of claim 35 wherein said document reception area is an input component for receiving original documents, wherein document processing functions are enabled based on said sensor output signals and said user identification information.

37. The device of claim 35 wherein said first set of sensor output signals are produced by a first set of said sensors and said second set of sensor output signals are produced by a second set of said sensors, wherein said detection signal is produced based on determining whether said first set of sensors is the same as said second set of sensors.

38. The device of claim 35 wherein each said sensor includes said one or more interrogation sources, said interrogation signal suitable for producing a response signal in a radio frequency identification tag (RFID) disposed upon said structure.

39. The device of claim 35 wherein said RFID tag is disposed in said document.

40. The device of claim 35 wherein there is only a single interrogation source comprising a transmitter circuit to generate and transmit an interrogation signal suitable for producing a response signal in a radio frequency identification device (RFID) disposed upon said structure.

41. The device of claim 40 wherein said sensors are antennas, each having an associated receiver circuit.

42. The device of claim 35 wherein said document processing apparatus includes one of a printer, a copier, and a facsimile transmission machine.

* * * * *